US005745097A

United States Patent [19]

Cappels

[11] Patent Number: 5,745,097

[45] Date of Patent: Apr. 28, 1998

[54] APPARATUS AND METHOD FOR AUTOMATIC IMAGE DISPLAY ALIGNMENT

[75] Inventor: Richard D. Cappels, San Jose, Calif.

[73] Assignee: Apple Computer, Inc., Cupertino, Calif.

[21] Appl. No.: 555,158

[22] Filed: Nov. 8, 1995

[51] Int. Cl.[6] ..... G07G 5/34

[52] U.S. Cl. ..... 345/121; 348/558; 315/8

[58] Field of Search ..... 345/205, 211, 345/213, 904, 121, 132, 126; 348/558, 554; 315/8, 85, 346

[56] References Cited

U.S. PATENT DOCUMENTS

| | | | |
|---|---|---|---|
| 5,021,719 | 6/1991 | Arai et al. | 315/364 |
| 5,134,390 | 7/1992 | Hishimoto et al. | 345/126 |
| 5,579,029 | 11/1996 | Arai et al. | 345/213 |

*Primary Examiner*—Dennis-Doon Chow
*Attorney, Agent, or Firm*—Carr & Ferrell, LLP

[57] ABSTRACT

The present invention is situated in the presence of an image source having an image and a display device having an image alignment register, a pixel address, and a pixel signal, the display device coupled to the image source. The apparatus of the present invention preferably comprises a pixel level comparator, a computer, and a pixel detection unit. The pixel level comparator is for setting a pixel detect signal to true if the pixel signal exceeds a threshold. The pixel level comparitor is coupled to the display device. The computer has a selected address and is coupled to the image alignment register. The pixel detection unit is for setting a pixel data signal to true if, while the pixel address and the selected address are equivalent, the pixel detect signal is set to true. The pixel detection unit is coupled to the display device, the pixel level comparitor and the computer. The method of the present invention is situated in the presence of a system including an image source having an image comprised of a plurality of image columns and a display device having a plurality of display screen columns. The method preferably comprises the steps of collecting pixel column address pixel presence signal data corresponding to the plurality of image columns and aligning the plurality of image columns within the plurality of display screen columns.

22 Claims, 13 Drawing Sheets

APPARATUS AND METHOD FOR AUTOMATIC IMAGE DISPLAY ALIGNMENT

BACKGROUND OF THE INVENTION

1. Field of the Invention

The present invention relates generally to apparatus and methods for orienting an image within a display. More particularly, the present invention is an apparatus and method for automatically aligning an image within a display.

2. Description of the Background Art Displays are well known in the art and are used to display a variety of images. Such images may be in the form of text, graphics or television signals. Based on timing signals (also known as "synchronization" or "sync" signals) transmitted with the image, the display knows approximately where on a display screen to write the image. The word "approximately" is used, since up until a few years ago there were a large variety of different image display standards and also large disparities in how even one set of image display standards were implemented. These image display standards were developed in part to effectively interface image sources produced by one manufacturer with image displays produced by another manufacturer. Of the aforementioned image display standards, a subset pertains to aligning an image within a display.

A properly aligned image permits ease of viewing and allows for a complete reproduction of the image on the display. However, if the image is not aligned, several rows or columns of text characters or graphic information may be missing, resulting in a partially displayed image. Referring now to FIG. 1, an example of an improperly aligned image within a display screen is shown. As can be seen from FIG. 1, the improper alignment has resulted in several non-displayed image columns and several non-displayed image rows. Such an improperly aligned image is particularly detrimental when fixed-matrix displays, such as dot-matrix liquid crystal display screens, are used.

Prior art attempts to address the need to align an image within a display have required a user to manually tune the display's circuitry and to guess when the image is properly aligned within the display. If the user only needs to adjust the alignment circuitry once, the time and difficulty of aligning the image within a display is almost tolerable. This situation most often occurs when the display is permanently connected to a single image source. However, when the display is designed to interface with a large variety of image sources, each designed to a different image display standard, manual adjustment of the alignment circuitry becomes an ongoing chore each time the image source connected to the display is changed. For example, a conference room projector that accepts image signals from a plurality of image sources (such as video cassette recorders, mainframe computers, personal computers and laptop computers, each conforming to a different image display standard) needs to have its displayed images manually realigned each and every time the projector is connected to a different image source. This need for repeated alignment adjustments imposes a significant burden on the users of such projectors.

What is needed is an apparatus and method that automatically aligns an image within a display independent of a image source's image display standard.

SUMMARY OF THE INVENTION

The present invention is an apparatus and method for automatically aligning an image within a display, independent of an image source's image display standard.

The apparatus of the present invention comprises an image source that provides an image to a display. The display has an image alignment register and generates a pixel address and a pixel signal. The display is coupled to the image source. The apparatus of the present invention further comprises a pixel level comparator, a computer, and a pixel detection unit. The pixel level comparator sets a pixel detect signal to true only if the pixel signal exceeds a threshold. The pixel level comparator is coupled to the display. The computer generates a selected address which is transmitted to the image alignment register. The pixel detection unit sets a pixel data signal to true only if, while the pixel address and the selected address are equivalent, the pixel detect signal is set to true. The pixel detection unit is coupled to the display, the pixel level comparator and the computer.

The method of the present invention is situated in the presence of a system including an image source having an image comprised of a plurality of image columns and a display having a plurality of display screen columns. The method preferably comprises the steps of collecting pixel column address pixel presence signal data corresponding to the plurality of image columns and aligning the plurality of image columns within the plurality of display screen columns.

BRIEF DESCRIPTION OF THE DRAWINGS

FIGS. 8A, 8B and 8C are a flowchart of a preferred method for collecting pixel presence signal data.

DETAILED DESCRIPTION OF THE PREFERRED EMBODIMENT

The present invention is an apparatus and method for automatically aligning an image within a display screen, independent of an image display standard of an image source. Advantageously, the present invention automatically aligns an image within a display screen without requiring any manual adjustments by a user. The present invention effects the automatic alignment first by determining the number of rows and columns in the image generated by the image source. Next, the number of rows and columns capable of being displayed on the display screen are determined. The present invention then compares the size of the image to the size of the display screen, calculates the number of column positions and row positions by which the image is improperly aligned, determines the direction to shift the image so as to align the image in the display screen and finally commands the display device to shift the image. Thus, the present invention results in an automatically aligned image regardless of the image source's image display standard and the size of the display screen. More significantly, users of the present invention need not visually guess when the image is properly aligned and also need not be burdened with manually aligning the image every time a new image source is connected to the display device. While the row and column paradigm introduced above is most useful for projectors based on liquid crystal displays or other fixed matrix displays, those skilled in the art will recognize that non-fixed matrix displays such as those displaying video signals may also benefit from the present invention. More specifically, those skilled in the art will recognize that the row and column paradigm to be discussed in detail below is equivalent to a timing paradigm when applied to non-fixed matrix video signals. Thus, those skilled in the art will recognize that to detect a pixel signal in a certain column on a fixed matrix display is equivalent to detecting a pixel signal at a certain time on a non-fixed matrix display and that the present invention may be equally applied to both fixed matrix and non-fixed matrix displays.

Figure 1:
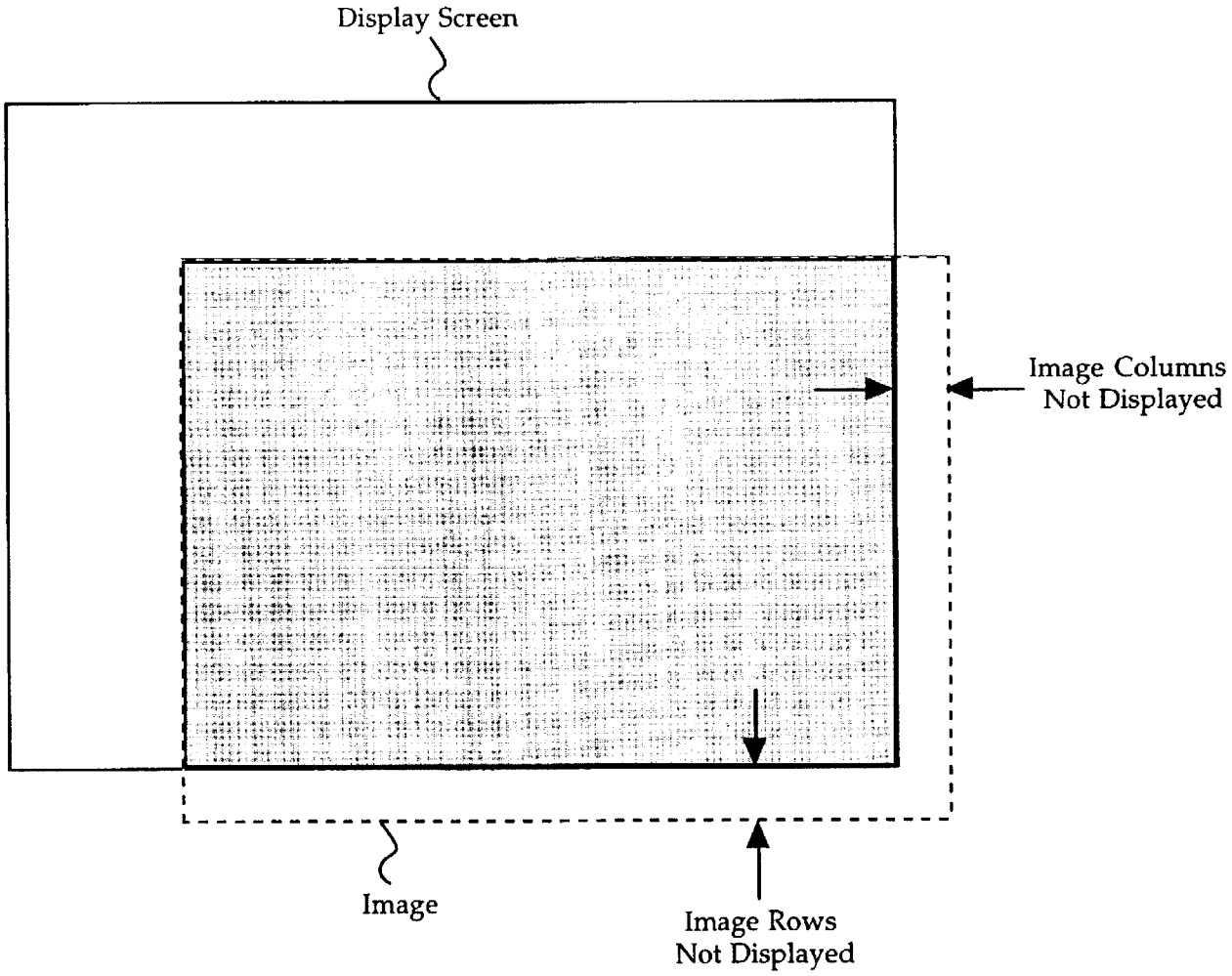
Fig. 1(Prior Art)
FIG. 1 is a diagram of an improperly aligned image relative to a display screen.
Figure 2:
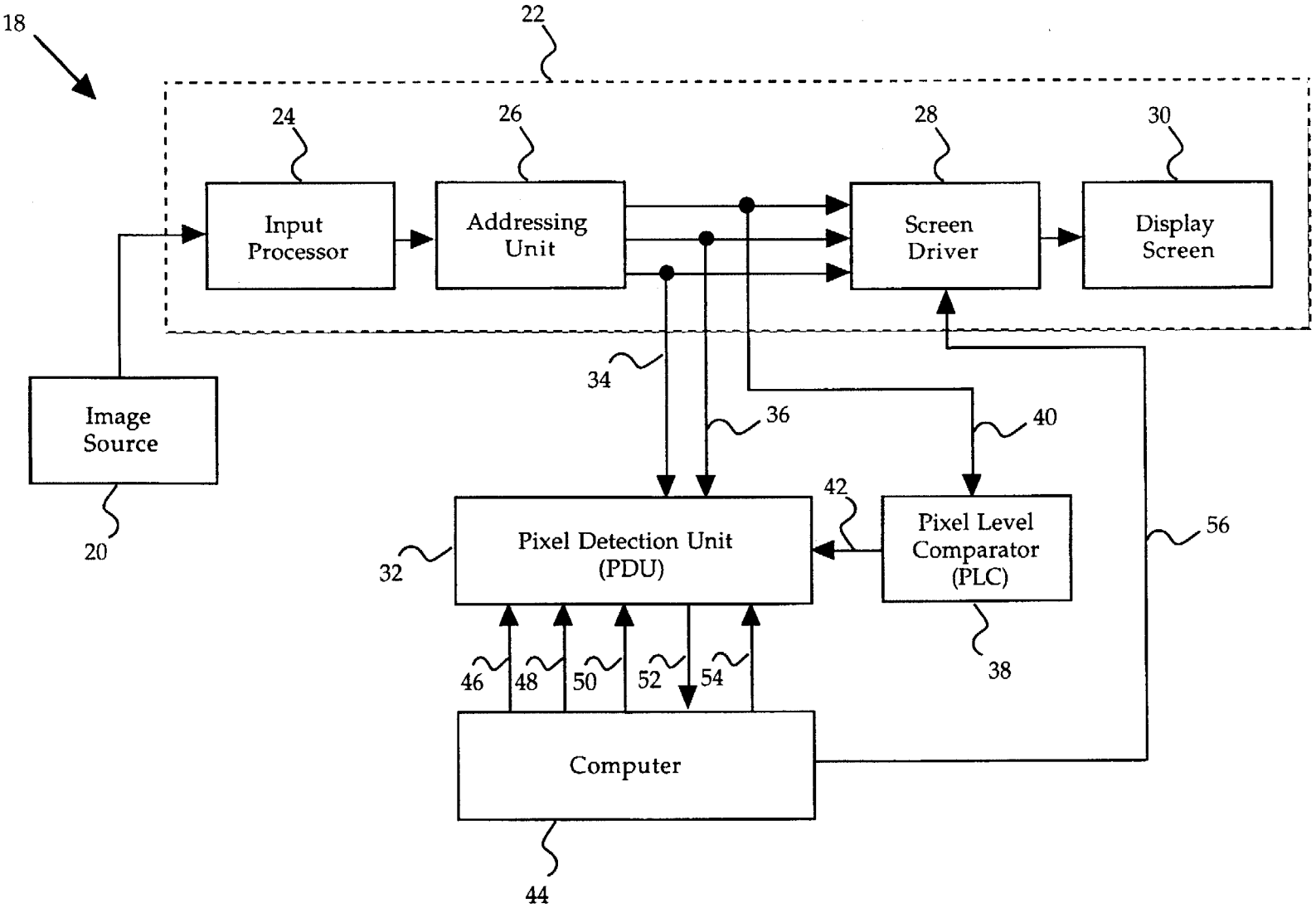
FIG. 2 is a block diagram of a preferred embodiment of an apparatus for automatic image alignment.

Referring now to FIG. 2, a block diagram of a preferred embodiment of an apparatus 18 for automatic image alignment is shown. The apparatus 18 comprises an image source 20, a display device 22, a Pixel Detection Unit (PDU) 32, a Pixel Level Comparator (PLC) 38 and a computer 44. The display device 22 preferably comprises an input processor 24, an addressing unit 26, a screen driver 28 and a display screen 30. The image source 20 is conventionally known and transmits an image signal carrying an image to the input processor 24 within the display device 22. The image is comprised of a plurality of pixel signals carried within the image signal. Pixel signals are either analog or digital picture elements that when combined make up the image viewed on the display screen 30 and are well known in the art. In the preferred embodiment, the image signal is either a plurality of conventional computer signals or a plurality video signals (i.e. NTSC, SECAM, PAL or some variant thereof), each further comprised of vertical-synchronization (V-sync) and horizontal-synchronization (H-sync) signals.

The input processor 24 is coupled to the image source 20. If the image signal is a conventional computer signal, the input processor 24 temporarily stores the computer signal in an input buffer, restores the computer signal's DC level and performs impedance matching. If the image signal is an encoded color video signal, the input processor 24 demodulates the video signal, in addition to performing the above operations.

The addressing unit 26 is conventionally known, is coupled to the input processor 24, and decodes the V-sync and H-sync signals that accompany the image signal. The V-sync and H-sync signals in composite image signals must first be separated from the image signal before the decoding operation can occur; however, non-composite image signals typically transmit their V-sync and H-sync signals on separate connector pins and therefore need not be separated before the decoding operation is performed. The present invention preferably accepts both composite and non-composite image signals. By decoding the V-sync and H-sync signals, the addressing unit 26 generates a Pixel Column Address (PCA) signal and a Pixel Row Address (PRA) signal for each of the pixel signals within the image signal. More specifically, upon receiving the H-sync signal the addressing unit 26 resets the PCA signal value, preferably to "0." Next, for every column pixel signal received, the addressing unit 26 increments the PCA signal value, preferably by "1." Thus, if "C" pixel signals are received between successive H-sync signals then the PCA signal values will preferably range from "0" through "C." The procedure for assigning PRA signal values for each row of pixel signals is performed the same way, except that the PRA signal value is reset each time the V-sync signal is received. The PCA signal and the PRA signal preferably map each of the pixel signals to a specific location on the display screen 30. As mentioned above, those skilled in the art will recognize that, while the above preferred embodiment of the present invention discusses a procedure for assigning PCA and PRA signal values to fixed matrix displays, the present invention may equally be applied to non-fixed matrix displays where the PCA signal value is instead based on a time from the receipt of the H-sync signal and the PRA signal value is instead based on a time from the receipt of the V-sync signal.

The addressing unit 26 next transfers the pixel signals, the PCA signals and the PRA signals to the screen driver 28. The addressing unit 26 also transfers the pixel signals over a pixel line 40 to the PLC 38 and transfers the PCA signals over a PCA line 34 and the PRA signals over a PRA line 35 to the PDU 32 and the computer 44.

The screen driver 28 is conventionally known and is coupled to the addressing unit 26 and the display screen 30 and routes each pixel signal to a location on the display screen 30 based on the PCA signal and PRA signal generated by the addressing unit 26. In addition, the screen driver 28 performs various other functions such as adjusting the brightness, color and alignment of the image on the display screen 30 as is conventionally known. The display screen 30 is conventionally known and is preferably a 640 column by 480 row visual output device for displaying the image to the user. Those skilled in the art will recognize that the display screen 30 could be of any column and row size. The screen driver 28 also includes a conventionally known image alignment register coupled to the computer 44 via a bus 56, which facilitates the computer's 44 control of the placement of the image on the display screen 30.

The PLC 38 is preferably embodied in an Application Specific Integrated Circuit (ASIC) and, as mentioned above, receives the pixel signals over the pixel line 40. The PLC 38 detects whether the pixel signals exceed a reference threshold. Circuits for effecting this comparison are well known in the art. If the pixel signals exceed the reference threshold then the PLC 38 sets a pixel detect signal to true and outputs the pixel detect signal to the PDU 32 on a pixel detect line 42. If the pixel signals do not exceed the reference threshold then the PLC 38 sets the pixel detect signal to false and outputs the pixel detect signal to the PDU 32 on the pixel detect line 42. In a typical scenario, the pixel signal will represent video information and the threshold is preferably set so that the pixel detect signal is set to false if a black pixel is detected within the image signal, while the pixel detect signal is set to true otherwise. Those skilled in the art will recognize that the "true" signal states in this discussion are equivalent to Boolean logic "1" states and the "false" signal states in this discussion are equivalent to Boolean logic "0" states. The PLC 38 is preferably either an analog video level comparator or a digital video level comparator. The choice between either the analog or the digital video level comparator is affected by such factors as the level of integration desired within the ASIC, cost considerations, and the accessibility of either digital or analog video signal paths. Details of the PDU's 32 operation are discussed below with reference to FIG. 3, and details of the computer's 44 operation and interface with the PDU 32 are discussed below with reference to FIG. 4.

Figure 3:
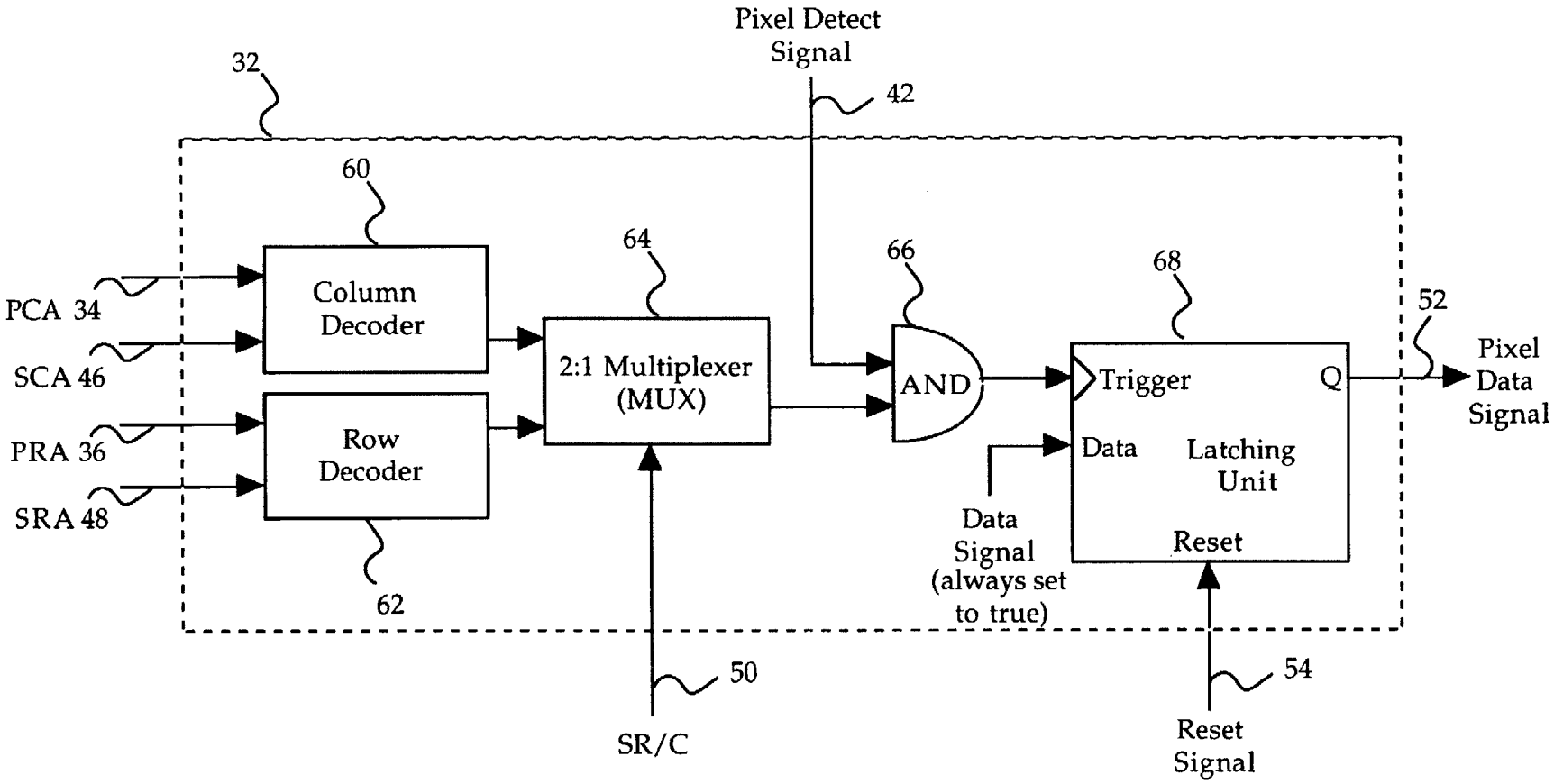
FIG. 3 is a block diagram of a preferred embodiment of a pixel detection unit of the present invention.

Referring now to FIG. 3, a block diagram of a preferred embodiment of the PDU 32 of the present invention is shown. The PDU 32 is preferably implemented within the ASIC and comprises a column decoder 60, a row decoder 62, a 2:1 multiplexer (MUX) 64, an AND gate 66 and a latching unit 68. The PDU 32 is coupled to and receives signals on: the PCA line 34 and the PRA line 36 from the addressing unit 26; the pixel detect line 42 from the PLC 38; and a select column address (SCA) line 46, a select row address (SRA) line 48, a select row/column (SR/C) line 50 and a reset line 54 from the computer 44. The PDU 32 also transmits a pixel data signal to the computer 44 via a pixel data line 52.

The column decoder 60 receives the PCA signal on the PCA line 34 from the addressing unit 26 and the SCA signal on the SCA line 46 from the computer 44. In the preferred embodiment, the column decoder 60 is a magnitude comparator, well known in the art, that outputs a true signal to the MUX 64 when the PCA signal and the SCA signal are equivalent and a false signal otherwise. In the preferred embodiment, the column decoder 60 is 10 bits wide so as to accommodate a typical 640 column by 480 row image signal format; however, those skilled in the art will recognize that the column decoder 60 can be of any bit width to accommodate an arbitrary number of columns. The row decoder 62 receives the PRA signal on the PRA line 36 from the addressing unit 26 and the SRA signal on the SRA line 48 from the computer 44. In the preferred embodiment, the row decoder 60 is also a magnitude comparator, well known in the art, that outputs a true signal to the MUX 64 when the PRA signal and the SRA signal are equivalent and a false signal otherwise. In the preferred embodiment, the row decoder 62 is also 10 bits wide so as to accommodate a typical 640 column by 480 row image signal format; however, those skilled in the art will recognize that the row decoder 62 can be of any bit width to accommodate an arbitrary number of rows.

The MUX 64 is well known in the art and is coupled to the column decoder 60 and the row decoder 62 and receives their respective output signals. The MUX 64 also receives a SR/C signal over the SR/C line 50 from the computer 44. If the SR/C signal is set to "row," the MUX 64 routes the row decoder's 62 output signal to the AND gate 66. If the SR/C signal is set to "column," the MUX 64 routes the column decoder's 60 output signal to the AND gate 66.

The AND gate 66 is preferably of a conventional type well known in the art and is coupled to the MUX 64 and to the pixel detect line 42. The AND gate 66 outputs a true signal when both the output signal from the MUX 64 and the pixel detect signal on the pixel detect line 42 are set to true.

The latching unit 68 is preferably a "D" flip-flop of a type well known in the art. The latching unit 68 has a trigger input coupled to the AND gate's 66 output, a data input coupled to a data signal always set to true, a reset input coupled to the reset line 54 and a Q output coupled to the pixel data line 52. When the AND gate 66 output signal transitions from false to true, the trigger input detects this transition and the latching unit 68 sets the pixel data signal at the Q output to true. The pixel data signal remains set to true until the reset signal is set to true on the reset line 54. When the reset signal is set to true, the latching unit 68 sets the pixel data signal to false. The pixel data signal is transferred to the computer 44 for additional processing as will be described below.

Figure 4:
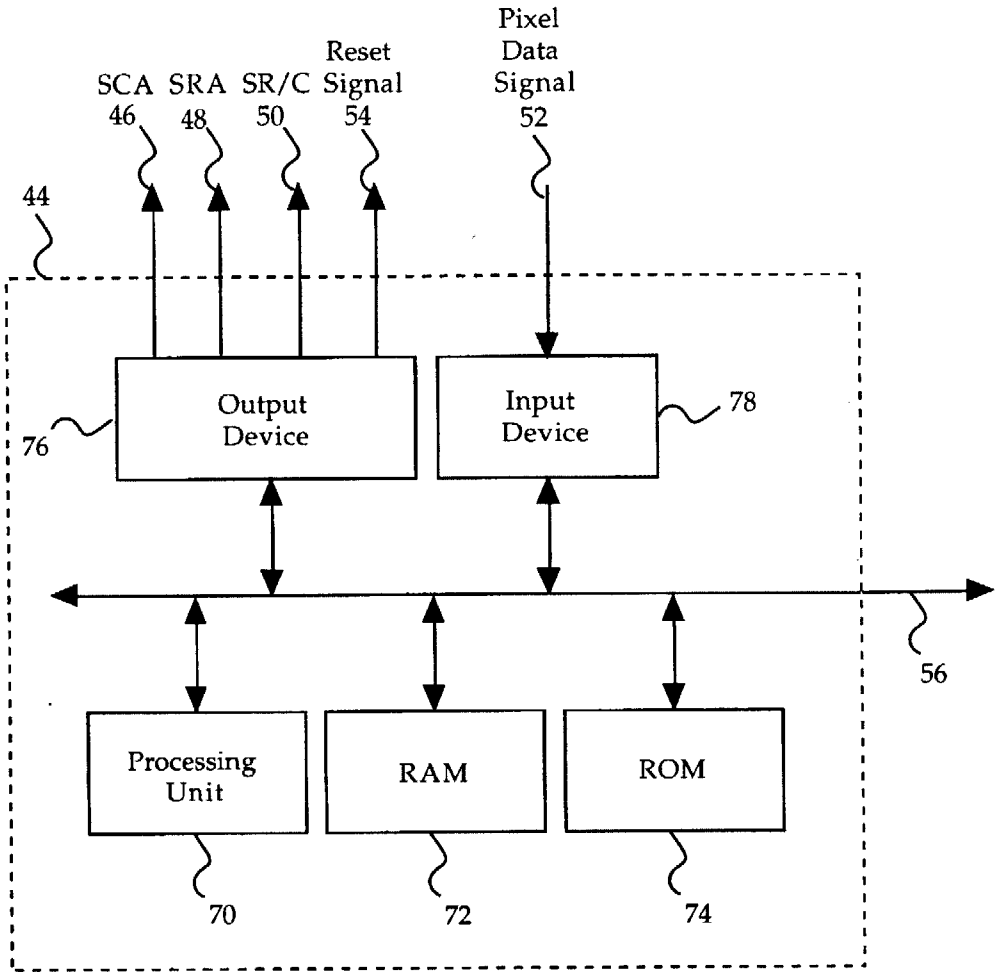
FIG. 4 is a block diagram of a preferred embodiment of a computer of the present invention.

Referring now to FIG. 4, a block diagram of a preferred embodiment of the computer of the present invention is shown. The computer 44 comprises a processing unit 70, a Random Access Memory (RAM) 72, a Read Only Memory (ROM) 74, an output device 76 and an input device 78, each coupled via the bus 56. In the preferred embodiment the RAM 72, the ROM 74, the output device 76 and the input device are integrated into the ASIC, while the processing unit 70 is preferably a separate microprocessor unit of a type well known in the art. Also, in the preferred embodiment, the computer 44 resides within the apparatus 18 for automatic image alignment; however, those skilled in the art will recognize that in an alternate embodiment, a stand-alone personal computer could carry out the computer's 44 functions.

The processing unit 70 executes programming instructions stored in the ROM 74 to perform data collection and image alignment operations, as described in detail below with reference to FIG. 5. The RAM 72 contains memory locations suitable for storing results from the computer's 44 data transformations as will be further described in detail below. The RAM 72 also contains memory locations suitable for storing the intermediate results generated by the processing unit 70. The ROM 74 preferably contains programming instructions and data controlling how the processing unit 70 accesses, transforms and outputs data, as described in detail below with reference to FIG. 5. Those skilled in the art will recognize that in alternate embodiments the ROM 74 could be replaced with a functionally equivalent computer readable medium such as: a compact disk and drive; a floppy disk and drive; and/or a memory card.

The output device 76 receives and buffers signals between the processing unit 70 and four outputs coupling the computer 44 to the PDU 32. More specifically, the output device 76 is coupled to the SCA line 46, the SRA line 48, the SR/C line 50 and the reset line 54. The input device 78 receives and buffers the pixel data signal received from the PDU 32. The input device 78 also preferably has a user-preference control and an image signal format selection control. The user-preference control allows the user to specify either centered, left-justified or right-justified image positioning, as will be elaborated upon below, while the image signal format selection control permits the user to select a particular image signal format. The functional operation and effect of these lines 46, 48, 50, 52, 54 are described in detail below with reference to FIG. 5.

Figure 5:
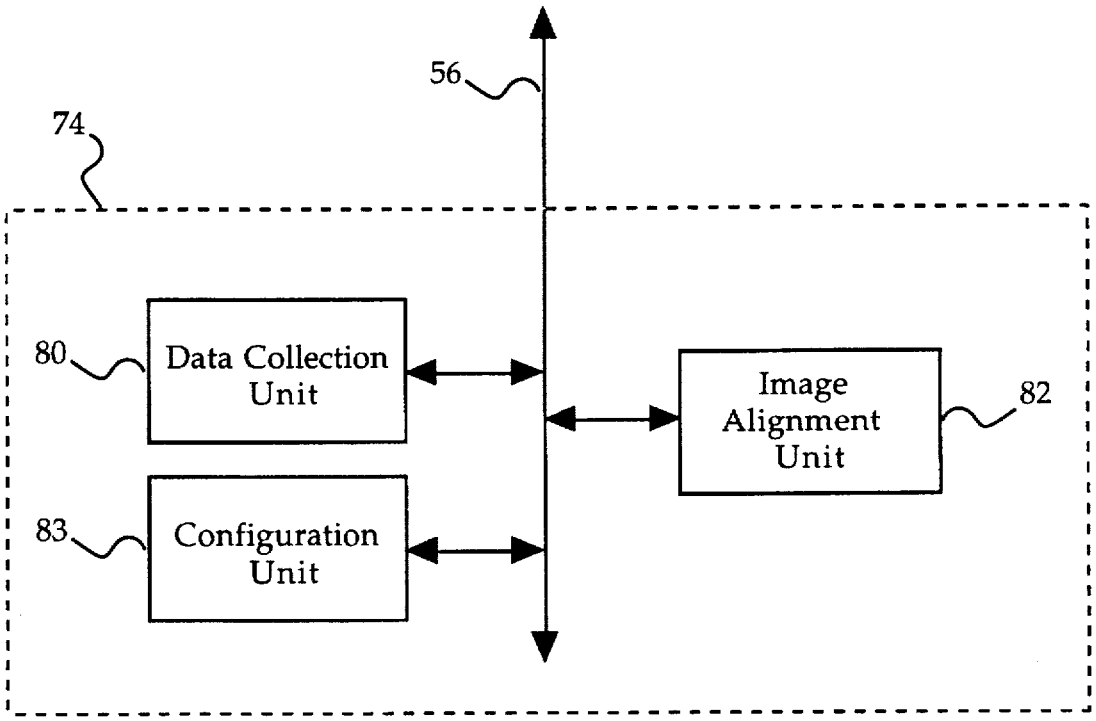
FIG. 5 is a block diagram of a preferred embodiment of a read only memory within the computer.

Referring now to FIG. 5, a block diagram of a preferred embodiment of the ROM 74 within the computer 44 is shown. The ROM 74 comprises a data collection unit 80, an image alignment unit 82 and a configuration unit 83, each coupled to the bus 56. The ROM 74 also contains a set of memory locations for storing various constants. In the preferred embodiment, the data collection unit 80 and the image alignment unit 82 comprise program instructions stored in the ROM 74 that are executable by the processing unit 70. The data collection unit 80 collects pixel data from the PDU 32 and the image alignment unit 82 interprets that data so as to send alignment signals over the bus 56 to the screen driver 28. The detailed operations performed by the data collection unit 80 and the image alignment unit 82 are described below. The configuration unit 83 is preferably comprised of data items that are accessible by the processing unit 70. The data items preferably stored in the configuration unit 83 include a total number of display screen 30 columns, a total number of display screen 30 rows, a display screen 30 memory address for each column and row and a set of image signal formats. The set of image signal formats are preferably obtained from the manufacturers of the image sources 20 and are accessed by the data collection unit's 80 program instructions in response to the particular image signal format specified by the input device's 78 image signal format selection control. The set of image signal formats also preferably includes a default image signal format to be accessed by the data collection unit 80 whenever a particular image signal format has not been specified by the input device's 78 image signal format selection control. The default image signal format includes a maximum number of image signal columns and rows that can be accepted by the addressing unit 26. The maximum number of image signal columns and rows are preferably stored in the configuration unit 83, at the time of manufacture, as constants. Those skilled in the art will recognize that different embodiments of the addressing unit 26 may be designed to accept a different maximum number of columns and rows within the image signal, depending upon the types of image signals the display device 22 is designed to interface with. More detail on the set of image signal formats and their effect on the data collection unit 80 is presented below.

Figure 6A:
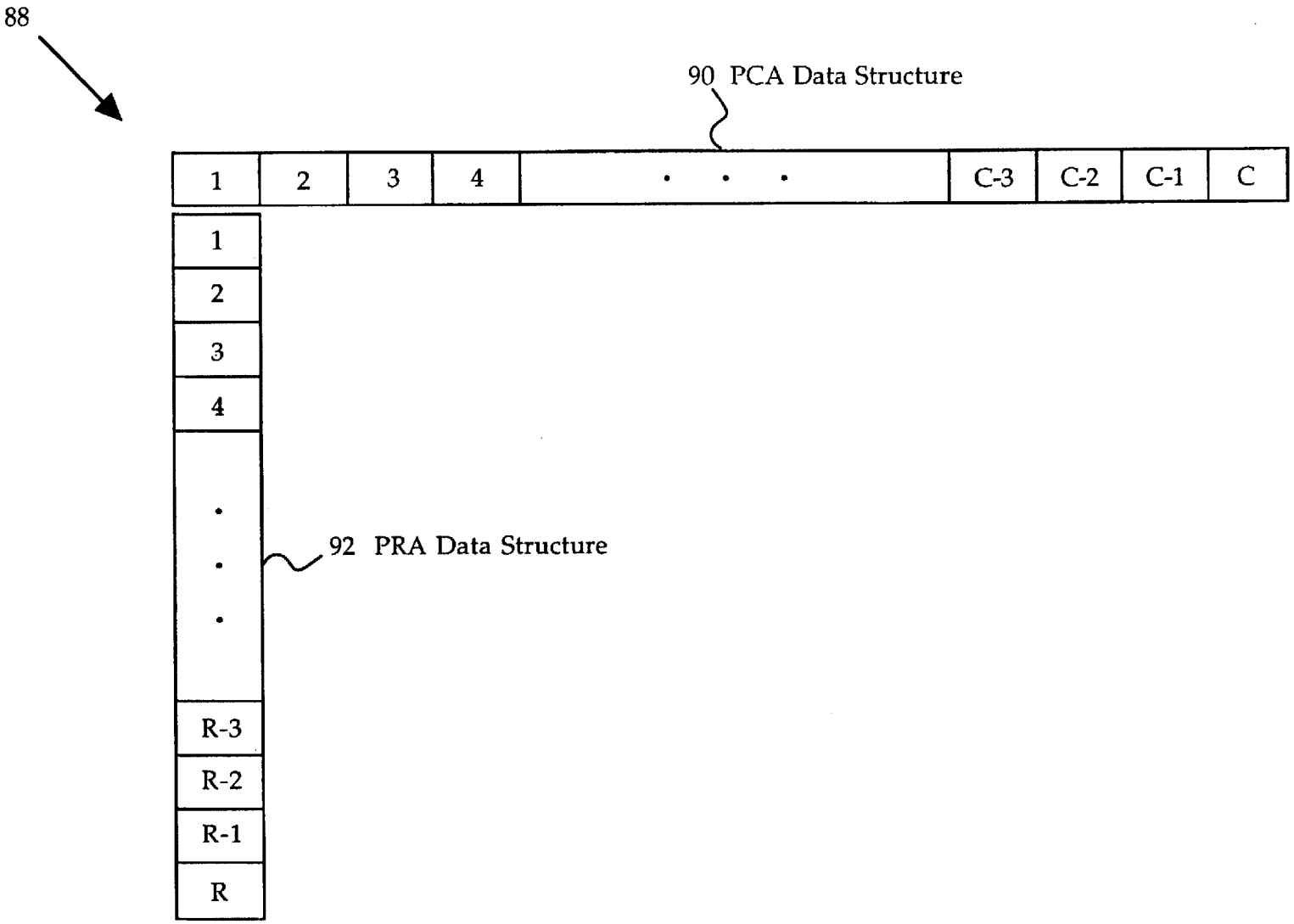
FIG. 6A is a block diagram of a preferred pixel data structure within a random access memory.

Referring now to FIG. 6A, a block diagram of a preferred pixel data structure 88 within the RAM 72 is shown. The pixel data structure 88 is comprised of a PCA data structure 90 and a PRA data structure 92. The PCA data structure 90 comprises a plurality of data fields sufficient to encompass the greatest number of pixel columns (C) that may be transmitted within the image signal. As shown in FIG. 6, the PCA data structure 90 has a first data field for column 1 of the image signal, a second data field for column 2 of the image signal and so on up to and including a C data field for column C of the image signal. Each data field within the PCA data structure 90 stores a pixel presence signal that is set to true if a pixel is present at that PCA and to false if a pixel is not present at that PCA. The PRA data structure 92 comprises a plurality of data fields sufficient to encompass the greatest number of pixel rows (R) that may be transmitted within the image signal. As shown in FIG. 6, the PRA data structure 92 has a first data field for row 1 of the image signal, a second data field for row 2 of the image signal and so on up to and including a R data field for row R of the image signal. Each data field within the PRA data structure 92 stores a pixel presence signal that is set to true if a pixel is present at that PRA and to false if a pixel is not present at that PRA. The manner in which the aforementioned data fields are assigned values is discussed in detail below.

Figures 6B, 6C, 6D:
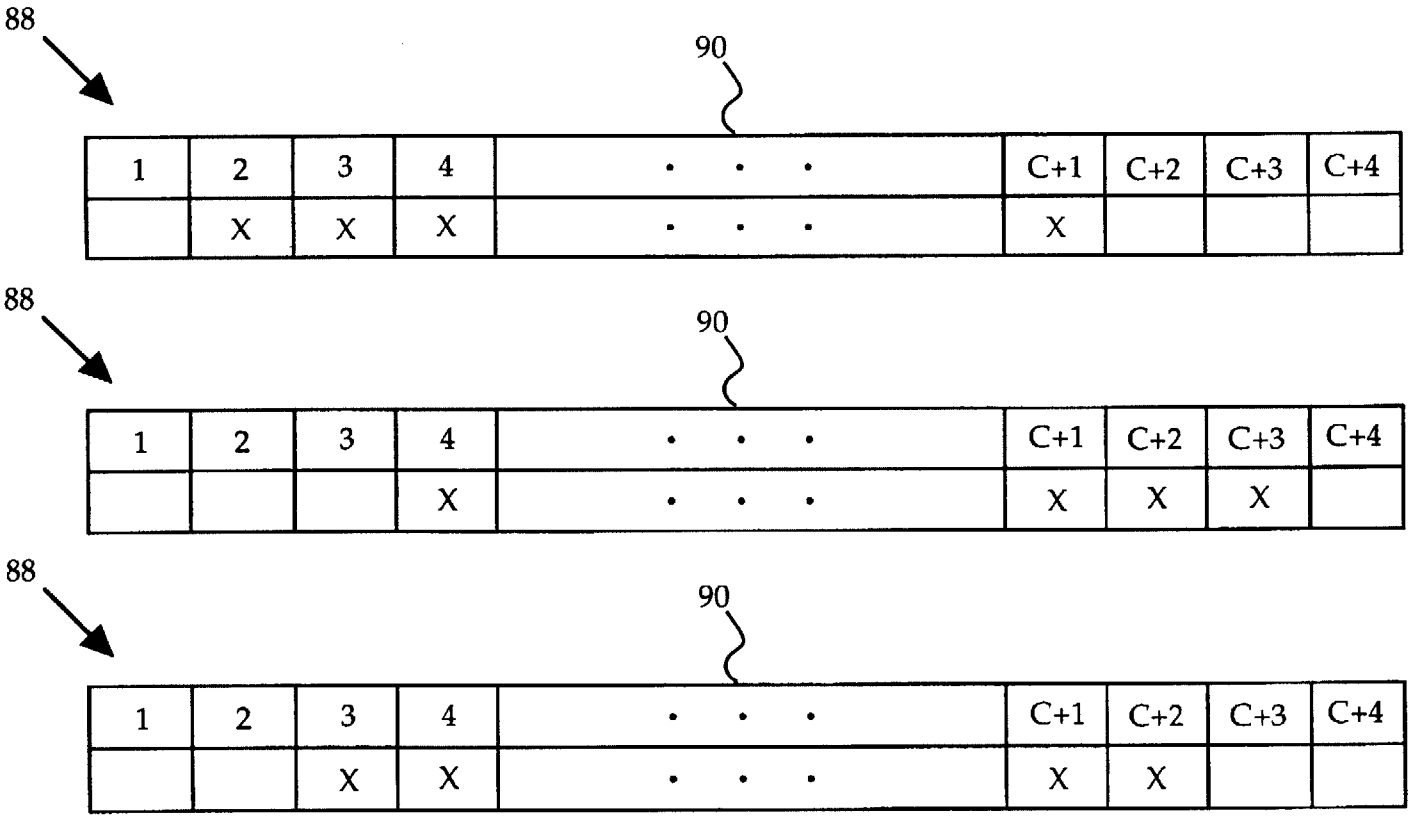
FIGS. 6B, 6C and 6D are block diagrams of several hypothetical sets of collected pixel presence signal data.

Referring now to FIGS. 6B, C & D, block diagrams of several hypothetical sets of collected pixel presence signals are shown stored in the PCA data structure 90. In the figures, an "X" means that the PLC 38 has detected a pixel signal at that PCA and has thus set the pixel presence signal to true. A "blank" means that the PLC 38 has not detected a pixel signal at that PCA and has thus set the pixel presence signal to false. The total number of columns in the hypothetical display screen 30 is C+4, and the total number of PCAs in the hypothetical image signal is C. FIG. 6B shows an image to the left of center which needs to be moved one column to the right. FIG. 6C shows an image to the right of center which needs to be moved one column to the left. And, FIG. 6D shows a properly centered image which does not need to be moved. Those skilled in the art would recognize that the above scenario could also be applied to several sets of pixel presence signals stored in the PRA data structure 92, where "C" is replaced by "R," "the left" is replaced by "up," and "the right" is replaced by "down."

As introduced above, the data collection unit 80 preferably comprises program instructions stored in the ROM 74 that are executed by the processing unit 70. Initially, the data collection unit 80 determines whether an image source 20 has been just connected to the apparatus 18 for automatic image alignment or has just been powered-on. Connection of the image source 20 to the apparatus 18 is determined in response to either of the following changes. Either no image signal was detected at a first time and then the image signal is detected at a second time, thus establishing that the image source 20 has just been connected; or the image signal's "signature" changed. An image signal "signature" is typically known as a unique combination of an image signal's horizontal frequency, vertical frequency and sync polarity. Using the "signature" detection method, the apparatus 18 can determine whenever multiple image sources 20 are rapidly switched between or whenever the image signal output from a single image source 20 is rapidly switched between different image signal formats. If the image source 20 has just been connected or powered-on, the data collection unit 80 will perform in conjunction with the image alignment unit 82 an immediate alignment of the image within the display screen 30 using the steps outlined below. However, if the image source 20 has been connected and powered-on for a period of time, the data collection unit 80 delays a predetermined period of time before beginning a next automatic alignment operation. In the preferred embodiment, the immediate alignment of the image within the display screen 30 is performed under the assumption that when the image source 20 has been initially connected to the display device 22 or powered-on, the user will want the image to be immediately aligned within the display screen 30 before s/he begins to use the display device 22. However, if the image source 20 has been connected to the display device 22 and powered-on for an extended period of time, the apparatus 18 assumes that the user has been using the display device 22 for some time and thus performs only rate-limited automatic alignment corrections. Such rate-limited corrections avoids creating a noticeably unstable image on the display screen 30.

The data collection unit 80 begins the automatic image alignment operation by correlating a pixel presence signal state with each of the image signal's PCAs and PRAs. While only the collection of pixel presence signal data for the PCAs will be discussed in detail below, those skilled in the art will recognize that preferably the exact same functional procedure is used to effect collection of pixel presence signal data for the PRAs. Thus, only the differences between the PRA's and PCA's collection procedures are discussed below.

The data collection unit 80 begins collection of the pixel presence signal data for each specific PCA by setting the SR/C signal to "column" on the SR/C line 50 and initializing the SCA signal to a first SCA. The data collection unit 80 resets the pixel data signal on the pixel data line 52 to false by setting the reset signal on the reset line 54 to true, thus clearing any previously output pixel data signal. The data collection unit 80 then preferably waits for the addressing unit 26 to cycle through at least one frame of the image signal. One frame of the image signal is equivalent to the addressing unit 26 cycling through the entire set of PCAs once. While the data collection unit 80 is waiting, the addressing unit 26 is continuously sending PCA signals over the PCA line 34 to the column decoder 60 and pixel signals over the pixel line 40 to the PLC 38. The PCA signals and the pixel signals output by the addressing unit 26 are typically changing at a very high rate. However, since the SCA signal on the SCA line 46 remains constant until changed by the data collection unit 80, the column decoder's 60 output is set to true only once every time the PCA signal is equivalent to the SCA signal. What follows are four possible scenarios where only one of the four scenarios results in the pixel data signal being set to true. Each of these four scenarios follow logically from the PDU's 32 operation discussed above. First, if the PCA signal is not equivalent to the SCA signal and the pixel detect signal is set to false, then the pixel data signal remains set to false. Second, if the PCA signal is equivalent to the SCA signal and the pixel detect signal is set to false, then the pixel data signal remains set to false. Third, if the PCA signal is not equivalent to the SCA signal and the pixel detect signal is set to true, then the pixel data signal remains set to false. However, in a fourth scenario where the PCA signal is equivalent to the SCA signal and the pixel detect signal is set to true, then the pixel data signal is set to true.

The data collection unit 80 examines the pixel data signal on the pixel data line 52. If the pixel data signal is set to true, the data collection unit 80 sets the pixel presence signal to true and stores that true state in the PCA data structure 90 data field which corresponds to the PCA signal. However, if the pixel data signal is set to false, the data collection unit 80 sets the pixel presence signal to false and stores that false state in the PCA data structure 90 data field which corresponds to the PCA signal. Next, the data collection unit 80 increments the SCA signal and repeats the above process for the new PCA signal which corresponds to the newly incremented SCA signal. This process is preferably repeated until all of the PCA signals are correlated with a pixel presence signal and each pixel presence signal is stored in the PCA data structure 90. Preferably the data collection unit 80 increments the SCA signal no higher than the maximum number of image signal columns that can be accepted by the addressing unit 26, as was stored in the configuration unit 83 and discussed above. FIGS. 6B, C & D present several hypothetical sets of pixel presence signal data corresponding to several hypothetical images. In FIG. 6B the image is off-center to the left and needs to be moved one column to the right. In FIG. 6C the image is off-center to the right and needs to be moved one column to the left. In FIG. 6D the image is properly centered and does not need to be aligned. How the present invention aligns these various images is discussed below.

If the data collection unit 80 receives a format specification signal from the image signal format selection control via the input device 78, indicating that an image signal from the image source 20 corresponds to one of the set of image signal formats preferably stored in the configuration unit 83 at the time of manufacture, the data collection unit 80 by-passes the method for filling up the PCA data structure 90 described above and instead accesses the one of the set of image signal formats which was indicated from the configuration unit 83. Each image signal format stored in the configuration unit 83 preferably references: a first PCA signal value corresponding to a column number after the image signal's H-sync signal that the data collection unit 80 would expect the PDU 32 to detect a first pixel signal in the image signal frame; a last PCA signal value corresponding to a column number before the image signal's H-sync signal that the data collection unit 80 would expect the PDU 32 to detect a last pixel signal in the image signal frame; and a maximum number of PCA signal values corresponding to a total number of columns within the image signal format indicated. The data collection unit 80 then preferably first sets the SCA signal equal to the first PCA signal value and assigns either a true or false value to the first PCA's pixel presence signal as per the method discussed above. Next the data collection unit 80 repeats this step with the SCA signal set to the first PCA signal value minus 1 and then again repeats this step with the SCA signal set to the first PCA signal value plus 1. If the format selection signal received from the input device is accurate, the data collection unit 80 expects to see the pixel presence signal corresponding to the first PCA's signal value set to true, the pixel presence signal corresponding to the first PCA's signal value minus one set to false, and the pixel presence signal corresponding to the first PCA's signal value plus one set to true. Similarly the data collection unit 80 repeats the above procedure with respect to the last PCA signal value so that the data collection unit 80 expects to see the pixel presence signal corresponding to the last PCA's signal value set to true, the pixel presence signal corresponding to the last PCA's signal value minus one set to true, and the pixel presence signal corresponding to the last PCA's signal value plus one set to false. If these expectations prove correct, the data collection unit 80 sets all of the PCA data structure's 90 pixel presence signals corresponding to the PCA signals greater than the first PCA signal value but less than the last PCA signal value to true and sets all of the PCA data structure's 90 pixel presence signals corresponding to the PCA signals less than the first PCA signal value and greater than the last PCA signal value to false. As a result of this alternate method for filling the PCA data structure 90 when the format specification signal is available, the preferred data collection unit 80 significantly reduces the amount of time required to fill the PCA data structure 90. If the format specification signal was not available the data collection unit 80 would operate as described in the preceding paragraph.

The data collection unit 80 fills the PRA data structure 92 preferably using the same basic process as discussed above for filling the PCA data structure 90, with the following changes. First, the data collection unit 80 sets the SR/C signal to "row," so that the MUX 64 selects the row decoder's 62 output. Second, the data collection unit 80 outputs the SRA signal to the row decoder 62 over the SRA line 48. All of the remaining PDU 32 components operate as described above, except that the data collection unit 80 increments the SRA signal no higher than the maximum number of image signal rows that can be accepted by the addressing unit 26, as was stored in the configuration unit 83 and discussed above. After the data collection unit 80 has filled both the PCA data structure 90 and the PRA data structure 92 with pixel presence data, the data collection unit 80 then transfers control to the image alignment unit 82.

The image alignment unit 82, after receiving control from the data collection unit 80, retrieves the total number of display screen 30 columns value from the ROM 74. Next, the image alignment unit 82 counts up a total number of PCAs that have their associated pixel presence signals set to true within the PCA data structure 90. The image alignment unit 82 then compares the total number of PCAs with their pixel presence signals set to true with the total number of display screen 30 columns. If the total number of PCAs with their pixel presence signals set to true is less than or equal to the total number of 30 screen columns, the image alignment unit 82 proceeds to calculate a number of column positions by which the image is off-center and a direction to shift the image, so as to center the PCAs within the display screen 30. The image alignment unit 82 performs the actual centering of image within the display screen 30 via control signals sent to the screen driver 28 over the bus 56. The control signals instruct the screen driver 28 to shift the image left or right by a number of columns and up or down by a number of rows. For example, in FIG. 6B the total number of PCAs is C, the total number of display screen 30 columns is C+4 and the image is one column off-center, thus the image must be shifted one column to the right to properly center the image within the display screen 30. As a result, the image alignment unit 82 sends a signal to the screen driver 28 to shift the image one column to the right. Those skilled in the art are aware of currently existing screen driver 28 protocols for commanding the display device 22 via the bus 56 interface. FIG. 6D shows the image after it has been centered within the display screen 30.

If after comparing the total number of PCAs with their pixel presence signals set to true to the total number of display screen 30 columns, the image alignment unit 82 determines that the total number of PCAs with their pixel presence signals set to true exceeds the total number of 30 screen columns, the image alignment unit 82 must preferably receive a signal from the input device 78 indicating whether to center, left-justify or right-justify the image within the display screen 30. In the preferred embodiment, the user-preference control is incorporated into the input device 78. The user-preference control allows the user to specify either centered, left-justified or right-justified image positioning. If a centered image is required, the image alignment unit 82 calculates the number of column positions by which the image is off-center and a direction to shift the image, so as to center the PCAs within the display screen 30. As a result of the centering, some of the pixel signals on the extreme left and right of the display screen 30 are not-displayed. The image alignment unit 82 commands the actual centering of the image within the display screen 30, in the manner discussed above. If the left-justified image is selected, the image alignment unit 82 calculates the number of column positions by which the image is off-left-justification and a direction to shift the image, so as to left-justify the PCAs with their pixel presence signals set to true within the display screen 30. As a result of the left-justification, some of the pixel signals on the extreme right of the display screen 30 are not-displayed. The image alignment unit 82 commands the actual left-justification of the image within the display screen 30, in the manner discussed above. If the right-justified image is selected, the image alignment unit 82 calculates the number of column positions by which the image is off-right-justification and a direction to shift the image, so as to right-justify the PCAs with their pixel presence signals set to true within the display screen 30. As a result of the right-justification, some of the pixel signals on the extreme left of the display screen 30 are not-displayed. The image alignment unit 82 commands the actual right-justification of the image within the display screen 30, in the manner discussed above.

While the discussion above addresses only a preferred procedure for aligning the PCAs with their pixel presence signals set to true within the display screen 30, those skilled in the art will recognize that the same basic process applies toward how the image alignment unit 82 preferably aligns the PRAs with their pixel presence signals set to true within the display screen 30, except that the image alignment unit 82 retrieves the total number of display screen 30 rows value from the ROM 74.

Also, while the preferred embodiment has been shown to include the column decoder 60, the row decoder 62 and the MUX 64 sequentially collecting column pixel data and row pixel data, those skilled in the art will recognize that in an alternate embodiment two parallel PDUs 32 and computers 44 could be operated simultaneously. Thus, one PDU 32 and computer 44 would align the PCAs within the display screen 30 and the other PDU 32 and computer 44 would align the PRAs within the display screen 30. In such an alternate embodiment, one computer 44 with either a multi-tasking operating system or employing a parallel processing architecture could replace the two computers 44 just mentioned.

Figure 7:
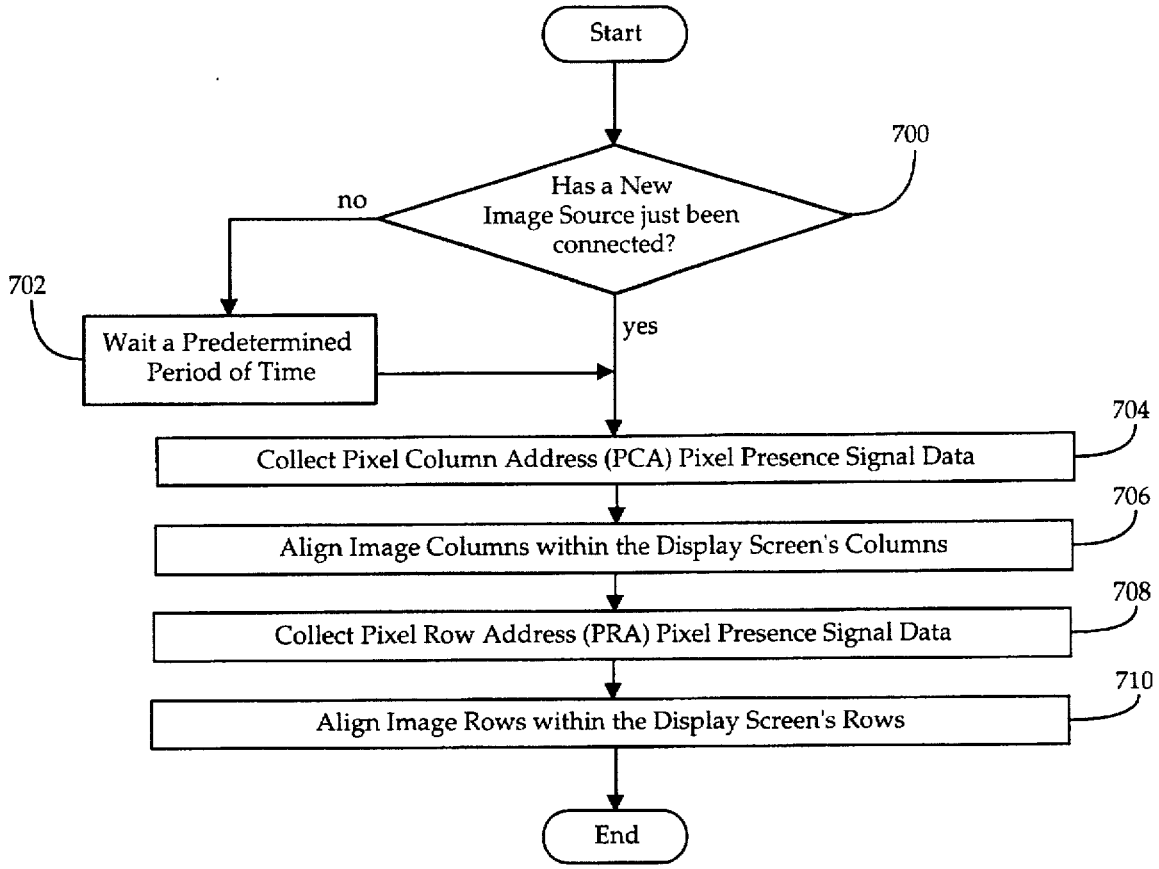
FIG. 7 is a flowchart of a preferred method for automatic image alignment.

Referring now to FIG. 7, a flowchart of a preferred method for automatic image alignment is shown. The preferred begins in step 700 where the data collection unit 80 checks whether a new image source 20 has just been connected to the display device 22, in the manner described above. If the new image source has just been connected, rate-limiting the image alignment is not required and the method immediately proceeds to step 704. However, if the new image source has not just been connected, rate-limiting the image alignment is preferred and the method proceeds to step 702 where the data collection unit 80 waits for a predetermined period of time before proceeding to step 704 and thus avoids creating jittery images on the display screen 30, as discussed above. The predetermined period of time is preferably chosen such that the frequency at which image alignments occur is low enough to nearly escape being essentially noticed by the user. For instance, if the predetermined period of time is set to one second, and the maximum image alignment to be performed is one pixel, then image alignment would be limited to one pixel per second. In step 704, the data collection unit 80 collects the PCA pixel presence signal data. Step 704 is described in detail below in FIGS. 8A, 8B and 8C. Next, in step 706, the image alignment unit 82 aligns the image columns within the display screen's 30 columns. The image columns referred to here are equivalent to the total number of PCAs discussed above. Step 706 is described in detail below in FIGS. 9A and 9B. The method then proceeds to step 708 where the data collection unit 80 collects the PRA pixel presence data. Those skilled in the art will recognize that the collection of the PRA pixel presence signal data in step 708 is functionally identical to the collection of the PCA pixel presence signal data in step 704. Therefore, those skilled in the art will recognize that by replacing the term "column" with "row," "SCA" with "SRA" and "PCA" with "PRA" in FIGS. 8A, 8B and 8C, the invention can be practiced so as to collect the PRA pixel presence signal data in step 708. Next, the method proceeds to step 710 where the image alignment unit 82 aligns the image rows within the display screen's 30 rows. The image rows referred to here are equivalent to the total number of PRAs discussed above. Those skilled in the art will recognize that aligning the image rows in step 710 is functionally identical to aligning the image columns in step 706. Therefore, those skilled in the art will recognize that by replacing the term "column" with "row," "PCA" with "PRA," "left" with "top," and "right" with "bottom" in FIGS. 9A & 9B, the invention can be practiced so as to align the image rows in step 710. After step 710, the preferred method ends.

Figure 8A:
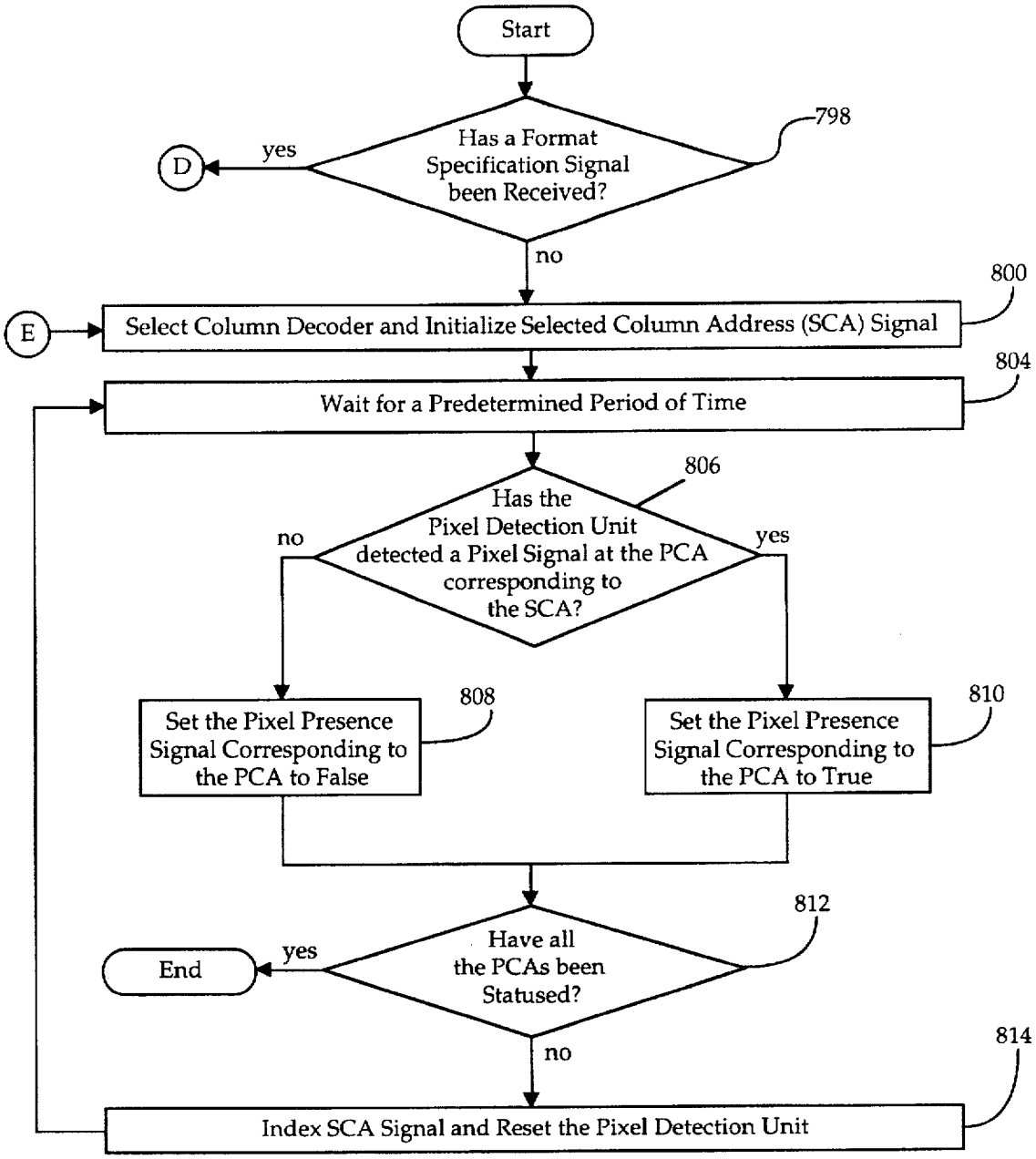
Figure 8B:
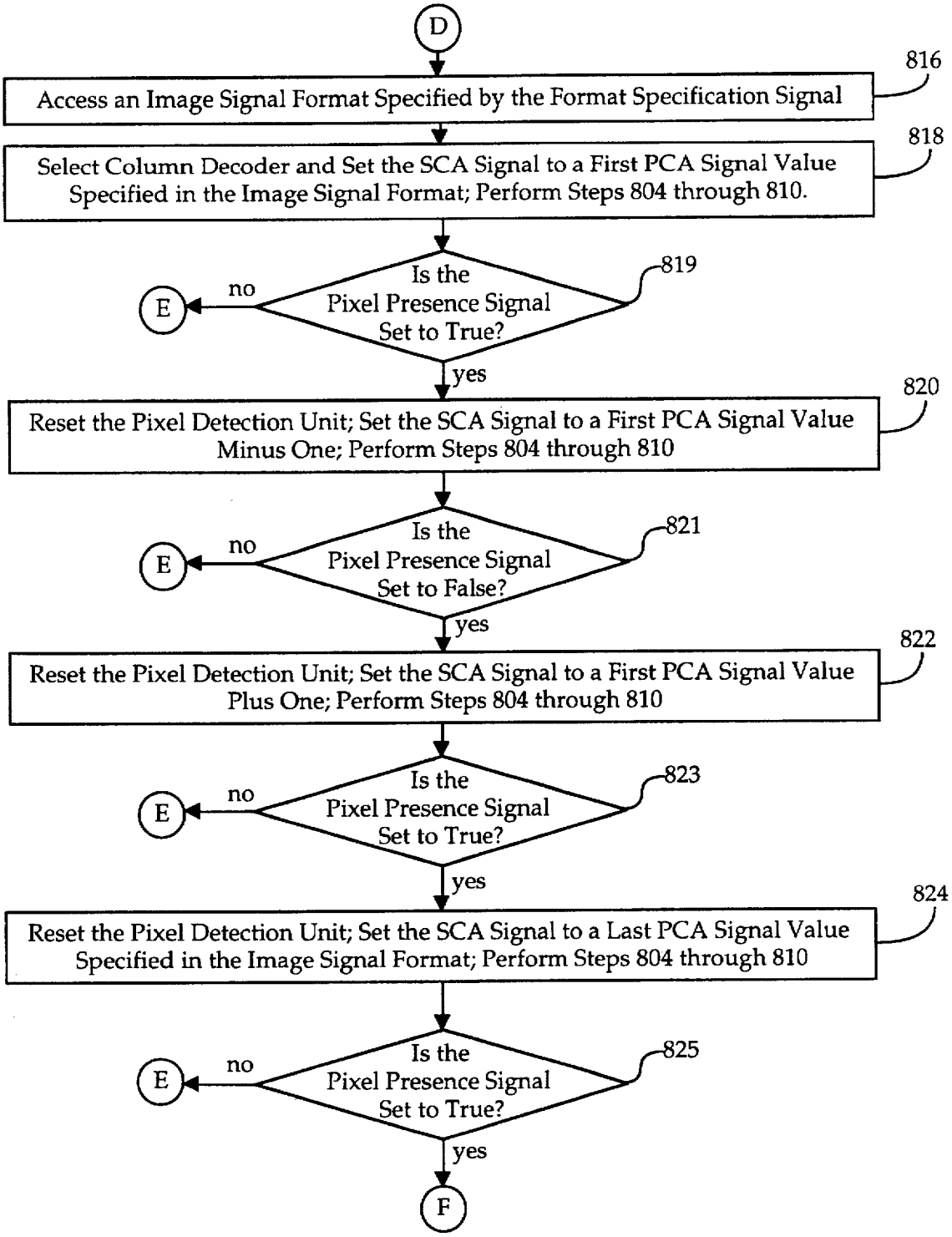

Referring now to FIGS. 8A, 8B and 8C, a flowchart of a preferred method for collecting the pixel presence signal data (step 704 of FIG. 7) is shown. The preferred method begins in step 798 where the data collection unit 80 determines whether the format specification signal has been received from the input device 78. If so, the method proceeds to step 816, else the method proceeds to step 800. In step 800, the data collection unit 80 selects the column decoder 60 and initializes the SCA signal, in the manner previously discussed. In the step 804, the data collection unit 80 waits for a predetermined period of time as was previously discussed. In step 806, the data collection unit 80 determines whether the PDU 32 has detected a pixel signal at the PCA corresponding to the SCA, in the manner discussed above. If in step 806 a pixel signal has not been detected, the method proceeds to step 808 where the data collection unit 80 sets the pixel presence signal to false and store the false state at the corresponding PCA in the PCA data structure 90, before proceeding on to step 812. However, if a pixel signal has been detected in step 806, the method alternately proceeds to step 810 where the data collection unit 80 sets the pixel presence signal to true and store the true state at the corresponding PCA in the PCA data structure 90, before proceeding on to step 812. In step 812, the data collection unit 80 determines whether or not all the PCAs have been selected and assigned a corresponding pixel presence signal status, in the manner discussed above. If all of the PCAs have been statused, the method ends. Else, the method proceeds on to step 814 where the SCA signal is indexed, the PDU 32 is reset, in the manner discussed above, and the method returns to step 804. As a result of the above method and after all the PCAs have been statused, each PCA will preferably have an associated pixel presence signal set to either true or false.

If in step 798 the format specification signal has been received, the method proceeds to step 816. In step 816 the data collection unit 80 accesses the image signal format specified by the format specification signal in the manner discussed earlier. Next in step 818, the data collection unit 80 selects the column decoder, sets the SCA signal to the first PCA signal value specified in the image signal format and performs steps 804 through 810. In step 819, the data collection unit 80 tests whether the pixel presence signal has been set to true. If the pixel presence signal was set to true, the preferred method proceeds to step 820, else the method proceeds to step 800. In step 820, the data collection unit 80 resets the PDU 32, sets the SCA signal to the first PCA signal value minus one and performs steps 804 through 810. In step 821, the data collection unit 80 tests whether the pixel presence signal has been set to false. If the pixel presence signal was set to false, the preferred method proceeds to step 822, else the method proceeds to step 800. In step 822, the data collection unit 80 resets the PDU 32, sets the SCA signal to the first PCA signal value plus one and performs steps 804 through 810. In step 823, the data collection unit 80 tests whether the pixel presence signal has been set to true. If the pixel presence signal was set to true, the preferred method proceeds to step 824, else the method proceeds to step 800. In step 824, the data collection unit 80 resets the PDU 32, sets the SCA signal to the last PCA signal value specified in the image signal format and performs steps 804 through 810. In step 825, the data collection unit 80 tests whether the pixel presence signal has been set to true. If the pixel presence signal was set to true, the preferred method proceeds to step 826, else the method proceeds to step 800.

In step 826, the data collection unit 80 resets the PDU 32, sets the SCA signal to the last PCA signal value minus one and performs steps 804 through 810. In step 827, the data collection unit 80 tests whether the pixel presence signal has been set to true. If the pixel presence signal was set to true, the preferred method proceeds to step 828, else the method proceeds to step 800. In step 828, the data collection unit 80 resets the PDU 32, sets the SCA signal to the last PCA signal value plus one and performs steps 804 through 810. In step 830, the data collection unit 80 tests whether the pixel presence signal has been set to false. If the pixel presence signal was set to false, the preferred method proceeds to step 832, else the method proceeds to step 800. In step 832, the data collection unit 80 sets all the pixel presence signals in the pixel data structure 90 for the PCA signals greater than the first PCA signal value but less than the last PCA signal value to true. In step 834, the data collection unit 80 sets all the pixel presence signals in the pixel data structure 90 for the PCA signals less than the first PCA signal value and greater than the last PCA signal value to false. As a result of the above method, each PCA will preferably have an associated pixel presence signal set to either true or false.

Figure 9A:
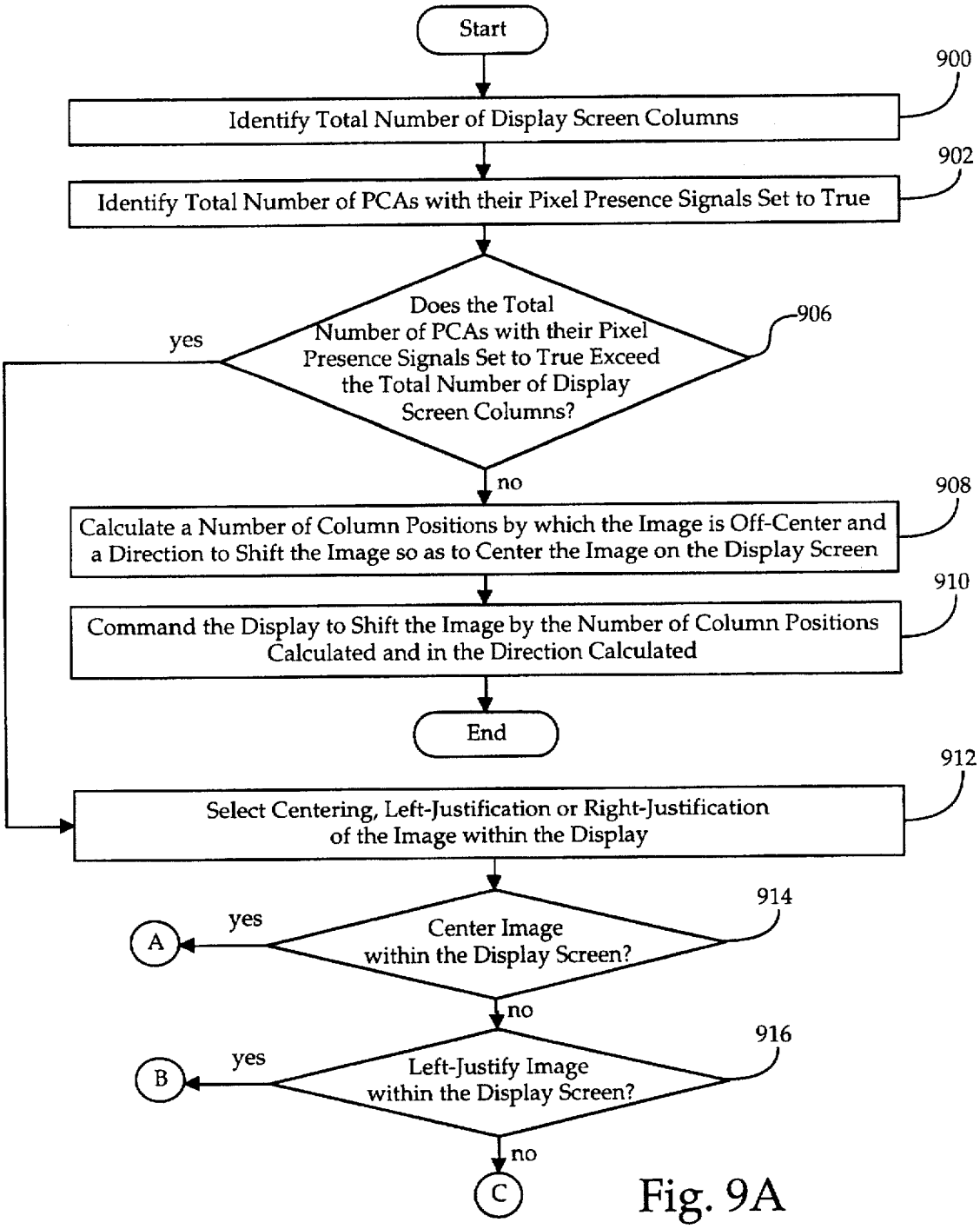
FIGS. 9A and 9B are a flowchart of a preferred method for aligning an image.
Figure 9A:
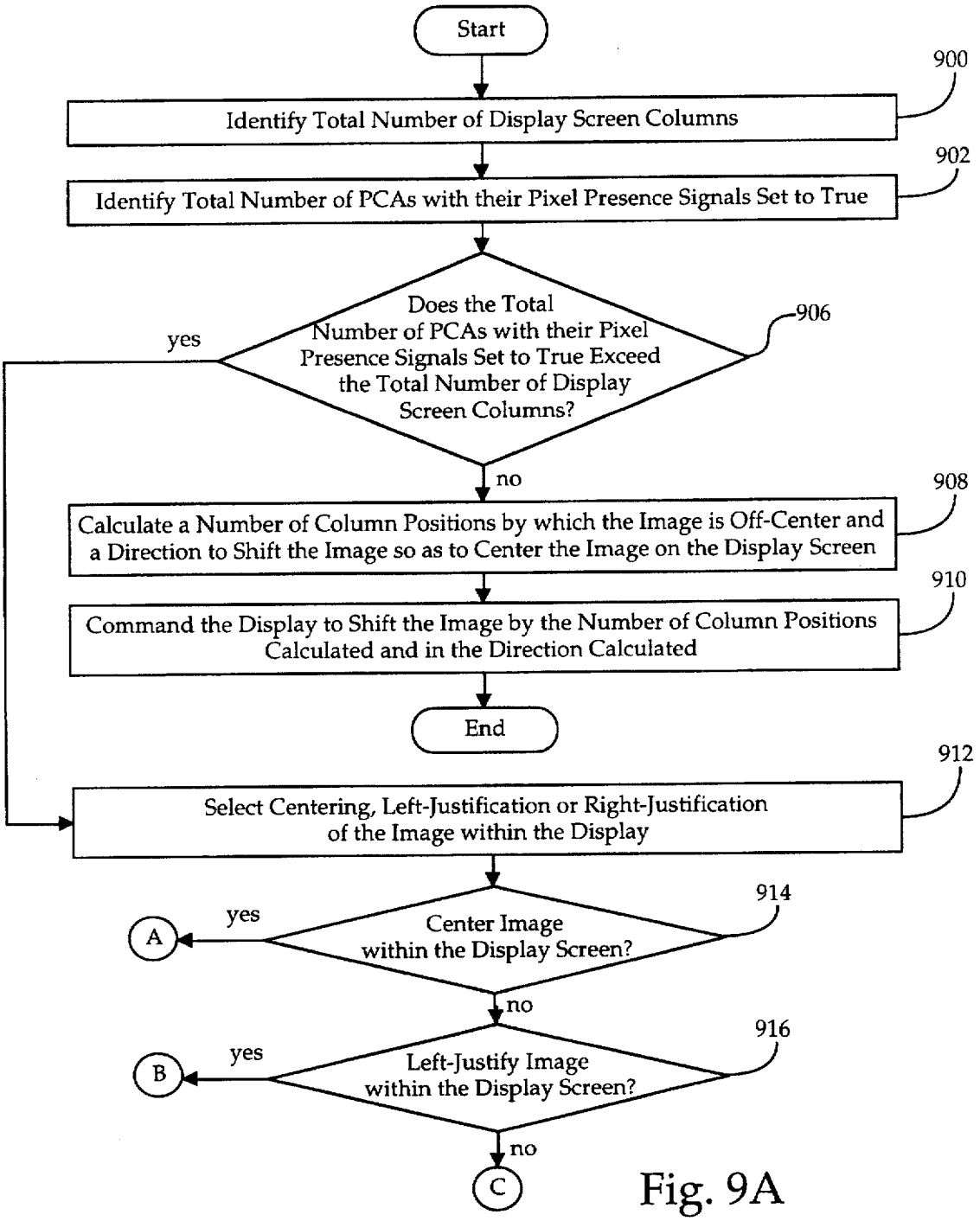
Figure 9B:
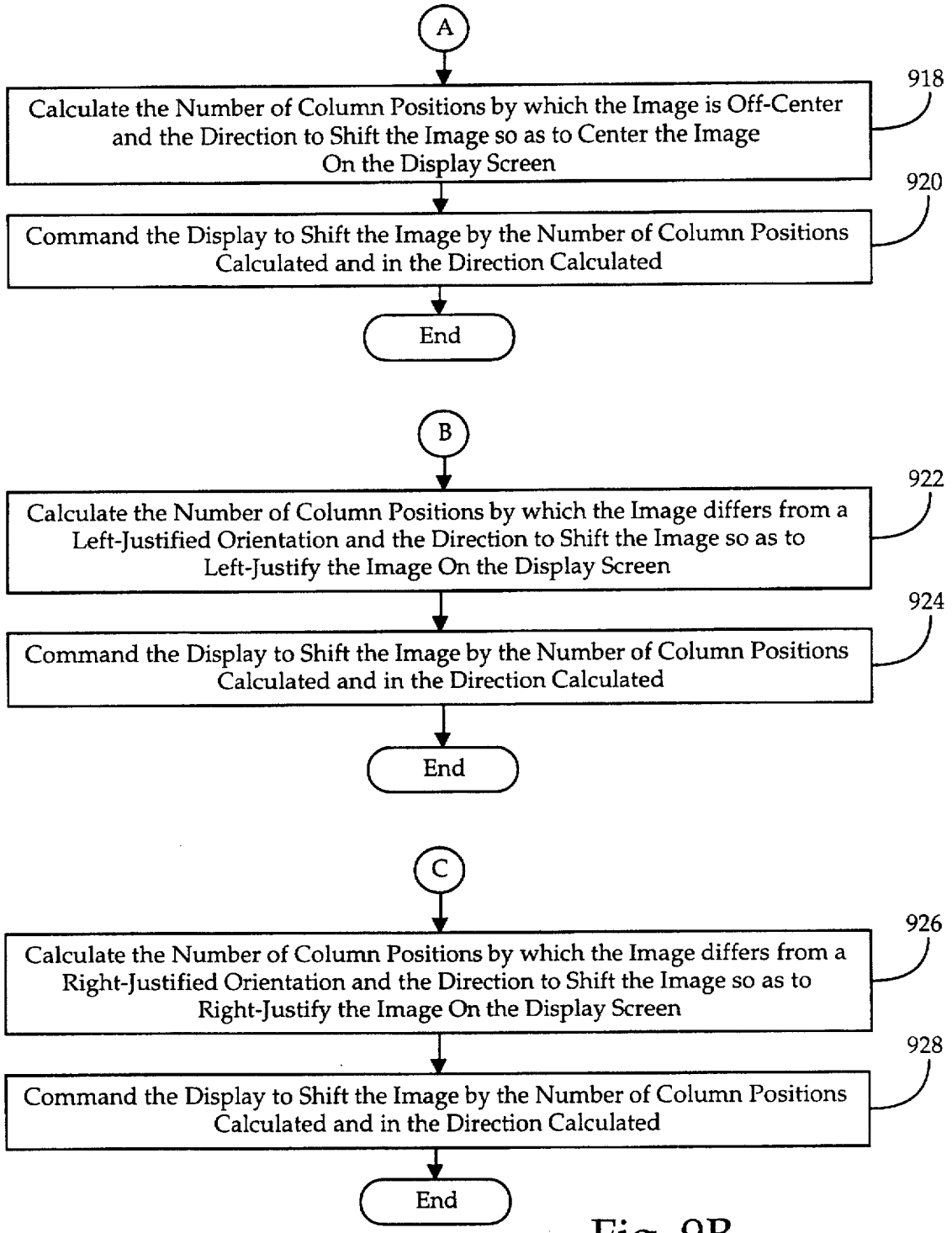

Referring now to FIGS. 9A and 9B, a flowchart of a preferred method for aligning an image (step 706 of FIG. 7) is shown. The method begins in step 900 with the image alignment unit 82 identifying the total number of display screen 30 columns, in the manner discussed above. In step 902, the image alignment unit 82 identifies the total number of PCAs with their pixel presence signals set to true, in the manner discussed above. The total number of PCAs with their pixel presence signals set to true is equivalent, by definition, to the width of the image signal as seen on the display screen 30. If, in step 906, image alignment unit 82 determines that the total number of PCAs with their pixel presence signals set to true does not exceed the total number of display screen 30 columns, the method proceeds to step 908. In step 908, the image alignment unit 82 calculates the number of column positions by which the image is off-center and the direction to shift the image so as to center the image on the display screen 30, in the manner discussed above. The method then proceeds to step 910 where the image alignment unit 82 commands the screen driver 28 to shift the image by the number of column positions calculated in step 908 and in the direction calculated in step 908, in the manner discussed above. After step 910, the preferred method ends. However, if in step 906, the total number of PCAs with their pixel presence signals set to true exceeds the total number of display screen 30 columns, the method proceeds to step 912. In step 912, the image alignment unit 82 preferably selects either the centered, left-justified or right-justified image format after accessing the user-preference signal from the input device 78, in the manner discussed above. If, in step 914, the centered image format was selected, the method then branches to step 918, as shown in FIG. 9B. In step 918, the image alignment unit 82 calculates a number of column positions by which the image is off-center and a direction to shift the image so as to center the image on the display screen 30, in the manner discussed above. Next, in step 920, the image alignment unit 82 commands the screen driver 28 to shift the image by the number of column positions calculated in step 918 and in the direction calculated in step 918, in the manner that was previously discussed. After step 920, the preferred method ends. If, in step 914, the centered image format was not selected, the method proceeds to step 916 and the image alignment unit 82 determines whether the left-justified image format was selected. If so, the method branches to step 922, as shown in FIG. 9B. In step 922, the image alignment unit 82 calculates a number of column positions by which the image differs from a left-justified orientation and a direction to shift the images so as to left-justify the image on the display screen 30, in the manner discussed above. Next, in step 924, the image alignment unit 82 commands the screen driver 28 to shift the image by the number of column positions calculated in step 922 and in the direction calculated in step 922, as was previously discussed above. After step 924, the preferred method ends. If, in step 916, the left-justified image format was not selected, the method branches to step 926, as shown in FIG. 9B. In step 926, the image alignment unit 82 calculates a number of column positions by which the image differs from a right-justified orientation and a direction to shift the image so as to right-justify the image on the display screen 30, in the manner discussed above. Next, in step 928, the image alignment unit 82 commands the screen driver 28 to shift the image by the number of column positions calculated in step 926 and in the direction calculated in step 926, as was previously discussed. After step 928, the preferred method ends.

While the present invention has been described with reference to certain preferred embodiments, those skilled in the art will recognize that various modifications may be provided. Variations upon and modifications to the preferred embodiments are provided for by the present invention, which is limited only by the following claims.

What is claimed is:

1. An automatic image display alignment apparatus, including an image source having an image and a display device having an image alignment register, a pixel address, and a pixel signal, the display device coupled to the image source, said apparatus having means to compare the size of the image to the size of a display screen having column positions and row positions, calculate the number of column positions and row positions by which the image is improperly aligned, determine the direction to shift the image so as to align the image in a display screen and command the display device to shift the image, resulting in an automatically aligned image, said apparatus comprising:

a pixel level comparator, for setting, a pixel detect signal to true if the pixel signal exceeds a threshold, the pixel level comparator coupled to the display device;

a computer having a selected address, and coupled to the image alignment register; and a pixel detection unit, for setting a pixel data signal to true if, while the pixel address and the selected address are equivalent, the pixel detect signal is set to true, the pixel detection unit coupled to the display device, the pixel level comparator and the computer.

2. An automatic image display alignment apparatus, including an image source having an image and a display device having an image alignment register, a pixel address, and a pixel signal, the display device coupled to the image source, the apparatus comprising:

a pixel level comparator, for setting a pixel detect signal to true if the pixel signal exceeds a threshold, the pixel level comparator coupled to the display device;

a computer having a selected address, and coupled to the image alignment register; and a pixel detection unit, comprising:

a decoder, for setting a decoder output signal to true when the selected address is equivalent to the pixel address, the decoder coupled to the computer and the display device, a logical AND means, for setting an AND means output signal to true when the decoder output signal and the pixel detect signal are both set to true, the logical AND means coupled to the decoder and the pixel level comparator, and a latching unit, for setting a pixel data signal to true if the AND means output signal is set to true and for keeping the pixel data signal set to true until receiving a reset signal from the computer, the latching unit coupled to the logical AND means and the computers said pixel detection unit setting a pixel data signal to true if, while the pixel address and the selected address are equivalent, the pixel detect signal is set to true, the pixel detection unit coupled to the display device, the pixel level comparator and the computer.

3. An automatic image display alignment apparatus, having an image source for generating an image signal and a display device outputting a pixel address signal and a pixel signal corresponding to the image signal, and inputting an image alignment signal, the display device coupled to the image source, said apparatus having means to compare the size of the image to the size of a display screen having column positions and row positions, calculate the number of column positions and row positions by which the image is improperly aligned, determine the direction to shift the image so as to align the image in a display screen and command the display device to shift the image, resulting in an automatically aligned image, said apparatus comprising:

a memory, having a data collection unit comprising program instructions for associating a pixel presence signal state with the pixel address signal in response to the pixel signal and an image alignment unit comprising program instructions for automatically positioning the image signal within the display device in response to the state of the pixel presence signal; and a processing unit for executing the data collection unit's and image alignment unit's program instructions, receiving the pixel address signal and the pixel signal from the display device and sending, the image alignment signal to the display device, the processing unit coupled to the display device and coupled to the data collection unit and the image alignment unit within the memory.

4. The apparatus of claim 3, further comprising:

a pixel level comparator having a threshold, for setting a pixel detect signal to true if the pixel signal exceeds the threshold, the pixel level comparator coupled to the display device; and a pixel detection unit, for setting a pixel data signal to true if the pixel detect signal is set to true at the same time that the data collection unit sets the pixel address signal, the pixel detection unit coupled to the pixel level comparator and the data collection unit;

wherein the data collection unit further comprises program instruction for setting the pixel presence signal to true and associating the pixel presence signal with the pixel address signal if the pixel data signal is set to true.

5. A method for automatic image display alignment, within a system including an image source having an image comprised of a plurality of image columns and a display device having a plurality of display screen columns, the method comprising the steps of:

collecting pixel column address pixel presence signal data corresponding to the plurality of image columns;

aligning the plurality of image columns within the plurality of display screen columns;

calculating the number of column positions by which the image is improperly aligned;

determining the direction to shift the image so as to align the image in a display screen; and commanding the display device to shift the image, resulting in an automatically aligned image.

6. The method of claim 5, wherein the plurality of image columns are uniquely specified by a plurality of pixel column addresses, wherein the collecting step further comprises the steps of:

setting a pixel presence signal corresponding to a pixel column address to true if the image includes a pixel signal exceeding a threshold at the pixel column address; and setting the pixel presence signal corresponding to the pixel column address to false if the image lacks a pixel signal exceeding the threshold at the pixel column address.

7. The method of claim 5, wherein the system further includes a column decoder and a pixel level comparator having a threshold, and wherein the image further includes a plurality of pixel column addresses, wherein the collecting step further comprises the steps of:

initializing a pixel column address;

setting a pixel presence signal corresponding to the pixel column address to true if the image includes a pixel signal exceeding the threshold at the pixel column address;

setting the pixel presence signal corresponding to the pixel column address to false if the image lacks a pixel signal exceeding the threshold at the pixel column address; and indexing the pixel column address and repeating the first and second setting steps and the indexing step, if not all the pixel column addresses have an associated pixel presence signal.

8. The method of claim 5, wherein the aligning step further comprises the steps of:

identifying a total number of display screen columns;

identifying a total number of pixel column addresses;

calculating a number of column positions by which the image is misaligned;

calculating a direction to shift the image so as to align the image within the display device; and commanding the display device to shift the image by the number of column positions and in the direction specified.

9. A method for automatic image display alignment, within a system including an image source having an image comprised of a plurality of image columns and a plurality of pixel column addresses and a display device having a plurality of display screen columns, the method comprising the steps of:

collecting pixel column address pixel presence signal data corresponding to the plurality of image columns and this collection comprises the steps of:

accessing an image signal format having a first pixel column address signal value and a last pixel column address signal value;

verifying that each pixel presence signal corresponding to the first pixel column address, the first pixel column address plus one, the last pixel column address and the last pixel column address minus one is set to true;

verifying that each pixel presence signal corresponding to the first pixel column address minus one and the last pixel column address plus one is set to false;

setting the pixel presence signal for those pixel column addresses greater than the first pixel column address but less than the last pixel column address to true, if both of the verifying steps prove correct; and setting the pixel presence signal for those pixel column addresses less than the first pixel column address and those pixel column addresses greater than the last pixel column address to false, if both of the verifying steps prove correct; and aligning the plurality of image columns within the plurality of display screen columns.

10. A method for automatic image display alignment, within a system including an image source having an image comprised of a plurality of image columns and a display device having a plurality of display screen columns, the method comprising the steps of:

collecting pixel column address pixel presence signal data corresponding to the plurality of image columns;

identifying a total number of display screen columns;

aligning the plurality of image columns within the plurality of display screen columns;

identifying a total number of pixel column addresses;

calculating a number of column positions by which the image is misaligned;

calculating a direction to shift the image so as to align the image within the display device;

commanding the display device to shift the image by the number of column positions and in the direction specified;

selecting a centered, a left-justified or a right-justified image alignment, if the total number of pixel column addresses exceeds the total number of display screen columns;

wherein the first calculating step is replaced by the steps of:

calculating a number of column positions by which the image is off-center, if the centered image alignment was selected;

calculating a number of column positions by which the image is not left-justified, if the left-justified image alignment was selected;

calculating a number of column positions by which the image is not right-justified, if the right-justified image alignment was selected; and wherein the second calculating step is replaced by the steps of:

calculating a direction to shift the image so as to center the image within the display screen, if the centered image alignment was selected;

calculating a direction to shift the image so as to left-justify the image within the display screen, if the left-justified image alignment was selected;

calculating a direction to shift the image so as to right-justify the image within the display screen, if the right-justified image alignment was selected.

11. An apparatus for automatic image display alignment, within a system including an image source having an image comprised of a plurality of image columns and a display device having a plurality of display screen columns, said apparatus having means to compare the size of the image to the size of a display screen having column positions, calculate the number of column positions by which the image is improperly aligned, determine the direction to shift the image so as to align the image in a display screen and command the display device to shift the image, resulting in an automatically aligned image either centered, left-justified or right-justified, said apparatus comprising a:

means for collecting pixel column address pixel presence signal data corresponding to the plurality of image columns; and means for aligning the plurality of image columns within the plurality of display screen columns.

12. The apparatus of claim 11, wherein the plurality of image columns are uniquely specified by a plurality of pixel column addresses, wherein the means for collecting further comprises a:

means for setting a pixel presence signal corresponding to a pixel column address to true if the image includes a pixel signal exceeding a threshold at the pixel column address; and means for setting the pixel presence signal corresponding to the pixel column address to false if the image lacks a pixel signal exceeding the threshold at the pixel column address.

13. The apparatus of claim 11, wherein the system further includes a column decoder and a pixel level comparator having a threshold, and wherein the image further includes a plurality of pixel column addresses, wherein the means for collecting further comprises a:

means for initializing a pixel column address;

means for setting a pixel presence signal corresponding to the pixel column address to true if the image includes a pixel signal exceeding the threshold at the pixel column address;

means for setting the pixel presence signal corresponding to the pixel column address to false if the image lacks a pixel signal exceeding the threshold at the pixel column address; and means for indexing the pixel column address and repeating the first and second means for setting and the means for indexing, if not all the pixel column addresses have an associated pixel presence signal.

14. The apparatus of claim 11, wherein the means for aligning further comprises a:

means for identifying a total number of display screen columns;

means for identifying a total number of pixel column addresses;

means for calculating a number of column positions by which the image is misaligned;

means for calculating a direction to shift the image so as to align the image within the display screen; and means for commanding the display device to shift the image by the number of column positions and in the direction specified.

15. An apparatus for automatic image display alignment, within a system including an image source having an image comprised of a plurality of image columns and pixel column addresses and a display device having a plurality of display screen columns, the apparatus comprising a:

means for collecting pixel column address pixel presence signal data corresponding to the plurality of image columns; comprising means for accessing an image signal format having a first pixel column address signal value and a last pixel column address signal value;

means for verifying that each pixel presence signal corresponding to the first pixel column address, the first pixel column address plus one, the last pixel column address and the last pixel column address minus one is set to true;

means for verifying that each pixel presence signal corresponding to the first pixel column address minus one and the last pixel column address plus one is set to false;

means for setting the pixel presence signal for those pixel column addresses greater than the first pixel column address but less than the last pixel column address to true, if both of the verifying steps prove correct; and means for setting the pixel presence signal for those pixel column addresses less than the first pixel column address and those pixel column addresses greater than the last pixel column address to false, if both of the verifying steps prove correct; and means for aligning the plurality of image columns within the plurality of display screen columns.

16. An apparatus for automatic image display alignment, within a system including an image source having an image comprised of a plurality of image columns and pixel column addresses and a display device having a plurality of display screen columns, the apparatus comprising a:

means for collecting pixel column address pixel presence signal data corresponding to the plurality of image columns;

means for aligning the plurality of image columns within the plurality of display screen columns, said means for aligning further comprising:

means for identifying a total number of display screen columns, means for identifying a total number of pixel column addresses, means for calculating a number of column positions by which the image is misaligned, means for calculating a direction to shift the image so as to align the image within the display screen, and means for commanding the display device to shift the image by the number of column positions and in the direction specified; and means for selecting a centered, a left-justified or a right-justified image alignment, if the total number of pixel column addresses exceeds the total number of display screen columns;

wherein the first means for calculating is replaced by a:

means for calculating a number of column positions by which the image is off-center, if the centered image alignment was selected;

means for calculating a number of column positions by which the image is not left-justified, if the left-justified image alignment was selected;

means for calculating a number of column positions by which the image is not right-justified, if the right-justified image alignment was selected; and wherein the second means for calculating is replaced by a:

means for calculating a direction to shift the image so as to center the image within the display screen, if the centered image alignment was selected;

means for calculating a direction to shift the image so as to left-justify the image within the display screen, if the left-justified image alignment was selected;

means for calculating a direction to shift the image so as to right-justify the image within the display screen, if the right-justified image alignment was selected.

17. A computer useable medium having computer readable program code embodied therein, the program code causing a computer to perform automatic image display alignment, within a system including an image source having an image comprised of a plurality of image columns and a display device having a plurality of display screen columns, said system having means to compare the size of the image to the size of a display screen having column positions, calculate the number of column positions by which the image is improperly aligned, determine the direction to shift the image so as to align the image in said display screen and command the display device to shift the image, resulting in an automatically aligned image, said system performing steps comprising:

collecting pixel column address pixel presence signal data corresponding to the plurality of image columns; and aligning the plurality of image columns within the plurality of display screen columns.

18. The computer useable medium of claim 17, wherein the plurality of image columns are uniquely specified by a plurality of pixel column addresses, wherein the program code for performing the collecting step further comprises program code for:

setting a pixel presence signal corresponding to a pixel column address to true if the image includes a pixel signal exceeding a threshold at the pixel column address; and setting the pixel presence signal corresponding to the pixel column address to false if the image lacks a pixel signal exceeding the threshold at the pixel column address.

19. The computer useable medium of claim 17, wherein the system further includes a column decoder and a pixel level comparator having a threshold, and wherein the image further includes a plurality of pixel column addresses, wherein the program code for performing the collecting step further comprises program code for:

initializing a pixel column address;

setting a pixel presence signal corresponding to the pixel column address to true if the image includes a pixel signal exceeding the threshold at the pixel column address;

setting the pixel presence signal corresponding to the pixel column address to false if the image lacks a pixel signal exceeding the threshold at the pixel column address; and indexing the pixel column address and repeating the first and second setting steps and the indexing step, if not all the pixel column addresses have an associated pixel presence signal.

20. The computer useable medium of claim 17, wherein the program code for performing the aligning step further comprises program code for:

identifying a total number of display screen columns;

identifying a total number of pixel column addresses;

calculating a number of column positions by which the image is misaligned;

calculating a direction to shift the image so as to align the image within the display screen; and commanding the display device to shift the image by the number of column positions and in the direction specified.

21. A computer useable medium having computer readable program code embodied therein, the program code causing a computer to perform automatic image display alignment, within a system including an image source having an image comprised of a plurality of image columns and a plurality of pixel column addresses and a display device having a plurality of display screen columns, by performing steps comprising:

collecting pixel column address pixel presence signal data corresponding to the plurality of image columns, using program code for:

accessing an image signal format having a first pixel column address signal value and a last pixel column address signal value;

verifying that each pixel presence signal corresponding to the first pixel column address, the first pixel column address plus one, the last pixel column address and the last pixel column address minus one is set to true;

verifying that each pixel presence signal corresponding to the first pixel column address minus one and the last pixel column address plus one is set to false;

setting the pixel presence signal for those pixel column addresses greater than the first pixel column address but less than the last pixel column address to true, if both of the verifying steps prove correct; and setting the pixel presence signal for those pixel column addresses less than the first pixel column address and those pixel column addresses greater than the last pixel column address to false, if both of the verifying steps prove correct; and aligning the plurality of image columns within the plurality of display screen columns.

22. A computer useable medium having computer readable program code embodied therein, the program code causing a computer to perform automatic image display alignment, within a system including an image source having an image comprised of a plurality of image columns and a display device having a plurality of display screen columns, by performing steps comprising:

collecting pixel column address pixel presence signal data corresponding to the plurality of image columns; and aligning the plurality of image columns within the plurality of display screen columns and the aligning step includes program code for:

identifying a total number of display screen columns;

identifying a total number of pixel column addresses;

calculating a number of column positions by which the image is misaligned;

calculating a direction to shift the image so as to align the image within the display screen;

commanding the display device to shift the image by the number of column positions and in the direction specified;

selecting a centered, a left-justified or a right-justified image alignment, if the total number of pixel column addresses exceeds the total number of display screen columns;

wherein the first calculating step is replaced by the steps of:

calculating a number of column positions by which the image is off-center, if the centered image alignment was selected;

calculating a number of column positions by which the image is not left-justified, if the left-justified image alignment was selected;

calculating a number of column positions by which the image is not right-justified, if the right-justified image alignment was selected; and wherein the second calculating step is replaced by the steps of:

calculating a direction to shift the image so as to center the image within the display screen, if the centered image alignment was selected;

calculating a direction to shift the image so as to left-justify the image within the display screen, if the left-justified image alignment was selected;

calculating a direction to shift the image so as to right-justify the image within the display screen, if the right-justified image alignment was selected.

* * * * *

UNITED STATES PATENT AND TRADEMARK OFFICE

CERTIFICATE OF CORRECTION

PATENT NO : 5,745,097

DATED : April 28, 1998

INVENTOR(S) : Richard D. Cappels

It is certified that error appears in the above-identified patent and that said Letters Patent is hereby corrected as shown below:

In the claims:

Claim 2, Column 15, line 58, please delete "computers" and insert - - computer; - -.

Signed and Sealed this

Eleventh Day of May, 1999

*Attest:*

Q. TODD DICKINSON

*Attesting Officer*

*Acting Commissioner of Patents and Trademarks*